United States Patent [19]
Barlow et al.
[11] 4,282,798
[45] Aug. 11, 1981

[54] CONTROL VALVE UNIT FOR HYDRAULIC LINEAR ACTUATOR

[75] Inventors: Roland J. Barlow, Madison Heights; David L. Keem, Royal Oak, both of Mich.

[73] Assignee: Ex-Cell-O Corporation, Troy, Mich.

[21] Appl. No.: 87,274

[22] Filed: Oct. 22, 1979

[51] Int. Cl.[3] ..... F15B 13/16

[52] U.S. Cl. ..... 91/358 R; 91/437; 91/441; 91/451; 91/461

[58] Field of Search ..... 91/358 R, 358 A, 437, 91/385, 387

[56] References Cited

U.S. PATENT DOCUMENTS

| | | | |
|---|---|---|---|
| 1,912,184 | 6/1930 | Ferris et al. | 91/358 R |
| 2,216,973 | 10/1940 | Harrington et al. | 91/358 A |
| 2,416,097 | 2/1947 | Hansen, Jr. et al. | 91/437 |
| 3,541,927 | 11/1970 | Iijima | 91/437 |

FOREIGN PATENT DOCUMENTS

| | | | |
|---|---|---|---|
| 1150452 | 4/1969 | United Kingdom | 91/358 R |

*Primary Examiner*—Paul E. Maslousky
*Attorney, Agent, or Firm*—Reising, Ethington, Barnard, Perry & Brooks

[57] ABSTRACT

A control valve unit (10) disclosed includes a slide mechanism (14) mounted on a base (40) of the unit, a control member (18) driven by a hydraulic linear actuator (12) controlled by the unit, and a control valve (22) that feeds hydraulic fluid to the actuator and has a deactivator (24) that is engaged and moved by a pair of slides (16*a,b*) of the slide mechanism under the impetus of the control member movement in order to terminate driving of the actuator at its limits of movement. The slide mechanism includes a slideway on the base and a pair of fixed stops (62*a,b*) between which the movable slides are supported on the slideway and biased by a helical spring (68) against the stops. The helical spring is aligned with openings (66) in the slides and the control member (18) extends through the spring and the slide openings. Lugs (76*a,b*) on the control member for moving the slides are preferably adjustable so as to permit adjustment of the limits of actuator movement. A pair of cams (82*a,b*) respectively mounted on the pair of slides have cam surfaces for engaging the control valve deactivator (24) and are adjustable to control the deceleration rate of the actuator. A round cam surface of the deactivator and limit cam surfaces on the adjustable cams have a construction that permits adjustment of the deceleration rate without affecting the limits of actuator movement. A preferred slide rod construction of the slide mechanism and through-bolt clamp construction of the base are also provided as is a check valve and pressure relief valve arrangement that accommodates for different size areas on opposite sides of an actuator piston of the single connecting rod type.

15 Claims, 7 Drawing Figures

CONTROL VALVE UNIT FOR HYDRAULIC LINEAR ACTUATOR

TECHNICAL FIELD

This invention relates to a control valve unit for controlling the supply of hydraulic fluid to a hydraulic linear actuator that is alternately movable in opposite directions to provide movement in such directions for whatever purpose is required.

BACKGROUND ART

Hydraulic actuators are utilized in various industrial and other applications to provide movement in opposite directions under the control of hydraulic fluid supplied by a control valve unit. For example, material handling systems, conveyors, various metal removal machines, cold and hot forming machines, indexers, automatic loaders, and door positioners, etc. utilize hydraulic actuators to control positioning of components during operation.

Most hydraulic actuators are of the linear type and thus provide linear movement and positioning; however, some hydraulic actuators are of the rotary type and provide rotary motion and positioning. Hydraulic linear actuators are most often embodied by cylinders which include a housing and a piston that is received within the housing and has a connecting rod extending outwardly therefrom in order to provide connection of the cylinder for actuating movement. A bore within the cylinder housing receives the piston in a sealingly slidable relationship such that hydraulic fluid supplied to one or the other sides of the piston provides piston movement and accompanying driving of the associated connecting rod. Some hydraulic cylinders have two connecting rods extending from the piston thereof so as to have equal amounts of fluid supplied to the cylinder on one side of the piston thereof and ejected from the cylinder on the other side of the piston. However, the more conventional cylinder has only a single connecting rod and thus has a different area on the side thereof having the connecting rod than the area of the side thereof without any connecting rod. As such, different amounts of fluid are supplied to and ejected from such a cylinder during hydraulically actuated movement of its piston. One of the most common constructions of hydraulic cylinders incorporates a tubular housing and square end caps that are held in position against ends of the housing by through-bolts extending alongside the housing and through the corners of the end caps.

The U.S. patent of Barlow U.S. Pat. No. 3,954,045 is assigned to the assignee of the present invention and discloses a control unit for a hydraulic rotary actuator. This control unit includes a valve that supplies hydraulic fluid to the rotary actuator under the control of a solenoid assembly and a cam mechanism in order to control actuator rotation. The solenoid assembly opens the supply valve to initiate the hydraulically actuated rotation. Cams of the cam mechanism are contoured to close the supply valve and thereby terminate the actuator movement with a feedback action.

U.S. patent application Ser. No. 014,175, filed Feb. 22, 1979, is assigned to the assignee of the present invention and discloses a control valve unit for a hydraulic actuator of either the linear or the rotary type. This control valve unit includes a supply valve that is opened at a predetermined rate to control acceleration and closed by cams to provide deceleration of the actuator movement by a feedback action.

Other hydraulic control valves are disclosed by U.S. Pat. Nos. Re. 29,392; 2,879,644; 3,640,069; 3,693,385; 3,779,136; and 3,780,623.

DISCLOSURE OF INVENTION

An object of the present invention is to provide an improved control valve unit for use with a hydraulic linear actuator in order to provide operation of the actuator with a feedback action.

In carrying out the above object, the control valve unit includes a slide mechanism mounted on a base of the unit and having a pair of movable slides that are spring biased away from each other. A control member of the unit is driven by a hydraulic linear actuator with which the unit is used to respectively engage and move the pair of slides adjacent the limits of actuator movement. A control valve of the unit feeds hydraulic fluid to the actuator and has a deactivator that is operated by the slide movement in order to terminate the driving of the actuator.

Preferably, the slide mechanism includes a slideway on the base and a pair of fixed stops between which the movable slides are supported on the slideway and biased by a helical spring against the stops. The helical spring has ends engaged with the slides and is aligned with openings through the slides, and the control member extends through the spring and the slide openings. Lugs on the control member engage and move the slides and are preferably embodied as collars including adjustable mounts so as to permit adjustment of the locations at which driving of the linear actuator is terminated.

During use of the mounted unit, an adjustable cam on each slide engages and moves the deactivator of the control valve adjacent the associated limit of actuator movement. This engagement takes place at cam surfaces of the cams which are movable toward the deactivator from opposite directions and on opposite sides. Cam actuated movement of the deactivator to a central position from either direction terminates the supply of pressurized hydraulic fluid to the actuator from the control valve so as to terminate the actuator movement.

Each cam is mounted on the associated slide about a pivotal support axis and includes a positioner for providing positioning thereof about its support axis so as to control the deactivator movement in relationship to the linear actuator movement and thereby control the deceleration rate of the linear actuator. The deactivator includes a round cam surface of a radius $r_1$ and each adjustable cam has its cam surface provided with a limit cam surface positioned therealong at a location spaced from the associated pivotal support axis by a radius $r_2$ which is equal to $r_1$ so that the locations at which the linear actuator movement terminates are not affected by the adjusted positions of the cams.

A preferred construction of the slideway includes a pair of slide rods mounted on the base of the unit extending between the stops. Each slide has opposed slide surfaces that slidably engage the slide rods and one or more springs bias one of the slide rods against the associated slide surfaces in order to provide the slidable mounting of the slides for movement toward and away from the stops under the action of the helical spring and the lugs of the control member that is moved by the linear actuator.

An L-shaped construction of the base facilitates mounting of the unit on a hydraulic linear actuator of the through-bolt cylinder type. A right angle junction of the L-shaped base engages one of the through-bolts on an associated cylinder of this type and cooperative pairs of clamps engage the through-bolts on each side of the one through-bolt at the base junction so as to provide a secured mounting of the unit on the cylinder.

A check valve and a pressure relief valve arrangement of the control valve unit accommodates for the different amounts of hydraulic fluid that must be supplied to and ejected from a hydraulic linear actuator of the single connecting rod type as inertial or other forced piston movement takes place subsequent to operation of the control valve by the deactivator movement. A first conduit including the check valve feeds hydraulic fluid from a reservoir to the piston bore on the large area side thereof opposite its connecting rod side in order to accommodate for the increased fluid volume required as a result of any forced piston movement subsequent to termination of the control valve operation that moves the piston in a direction from its large area side toward its small area side at which the connecting rod is located. A second conduit including the pressure relief valve dumps hydraulic fluid from the large area side of the piston bore in order to accommodate for the decreased volume of hydraulic fluid permitted during any forced piston movement subsequent to termination of control valve operation that moves the piston in a direction from its small area side where the connecting rod is located toward its large area side.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
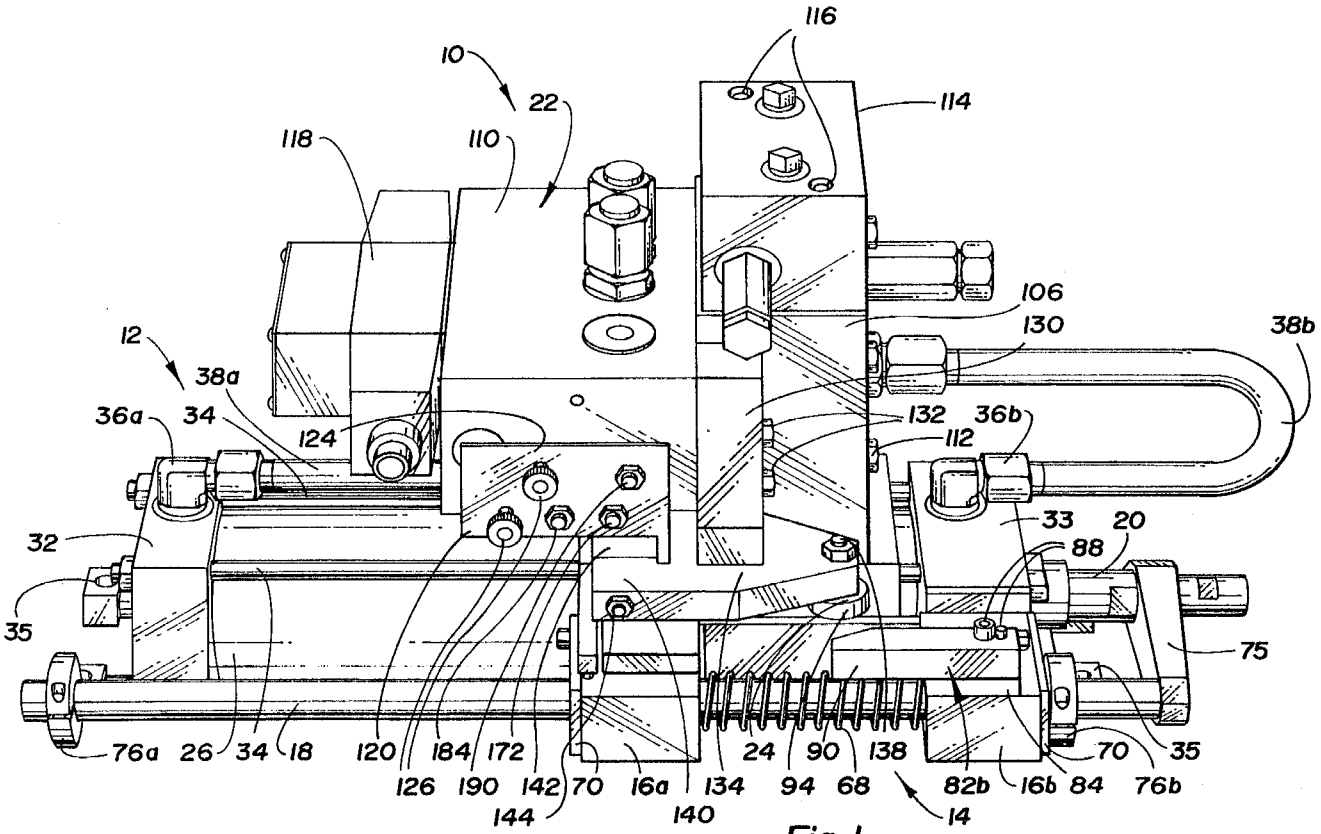
FIG. 1 is a perspective view of a control valve unit shown mounted on a hydraulic linear actuator and constructed in accordance with this invention to control operation of the actuator.

Referring to FIG. 1 of the drawings, a control valve unit constructed in accordance with the present invention is indicated generally by reference numeral 10 and is shown mounted on an associated hydraulic linear actuator embodied by a hydraulic cylinder 12 of the through-bolt type. A slide mechanism 14 of control valve unit 10 includes a pair of slides 16*a,b* that are moved by a control member 18 under the driving impetus of a piston rod 20 of cylinder 12 in order to control operation of the cylinder. A control valve 22 of the unit includes a deactivator 24 that is engaged and moved by the movement of the slides 16*a,b* under the impetus of the control member 18 in order to provide termination of the flow of hydraulic fluid to and from the cylinder 12 so as to terminate the movement of the piston connecting rod 20 toward the left and the right as is hereinafter more fully described.

Cylinder 12 includes an elongated tubular housing 26 (FIG. 1) defining a piston bore 28 (FIG. 7) in which a piston 30 connected to the inner end of rod 20 is movable to the left and the right in a sealingly slidable relationship. Opposite ends of the tubular housing 26 are sealed within round grooves in square end caps 32 and 33 which are held in position by four through-bolts 34 (FIGS. 1 and 4) extending through the corners of the end caps. Attachment lugs 35 (FIGS. 1, 2 and 3) are provided on end caps 32 and 33 for use in mounting of the cylinder, and a suitable seal within a central opening in end cap 33 slidably seals with the piston rod 20. Suitable fittings 36*a,b* are respectively threaded onto the end caps 32 and 33 and feed hydraulic fluid to and from the hydraulic cylinder 12 through suitable hose conduits 38*a,b* in order to control movement of the piston 30 shown in FIG. 7 by operation of the control valve 22. Such piston movement is accompanied by extension or retraction of rod 20 such that the cylinder can be used to provide driving movement or positioning for whatever purpose required.

Figure 4:
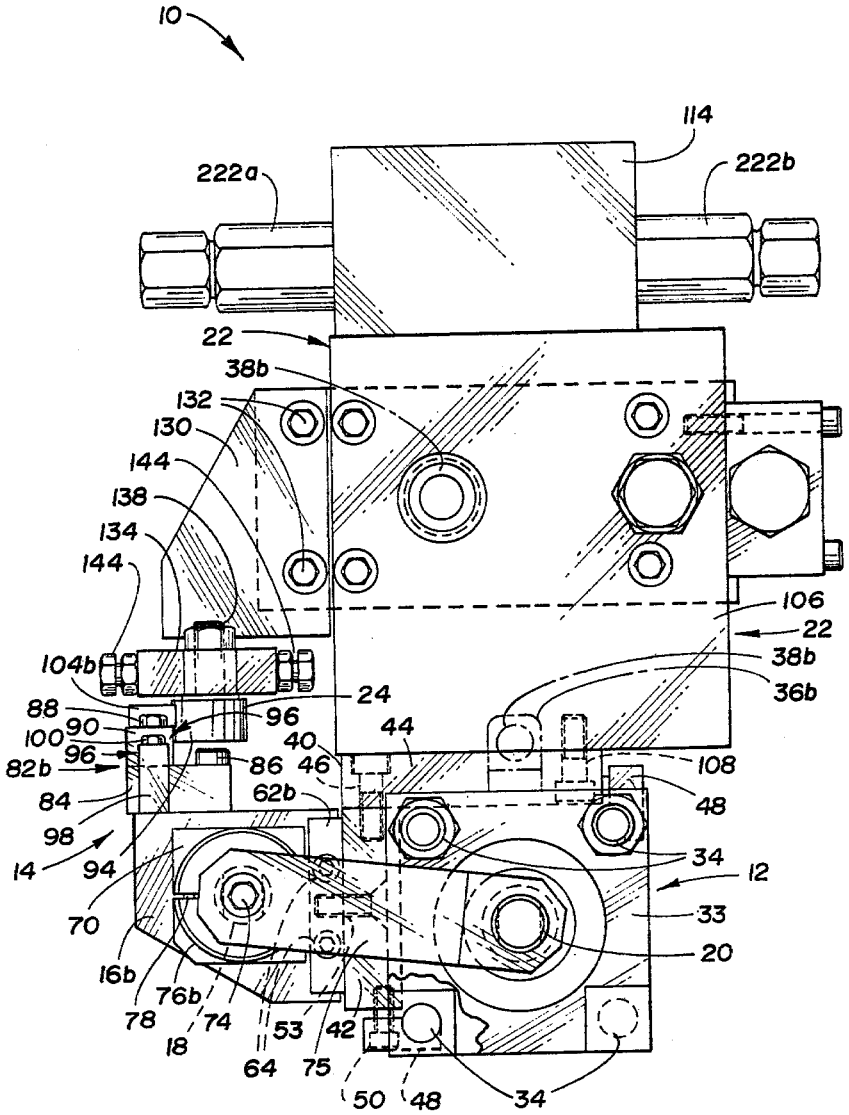
FIG. 4 is an end view of the control valve unit and the actuator taken along line 4—4 of FIG. 2.
Figure 6:
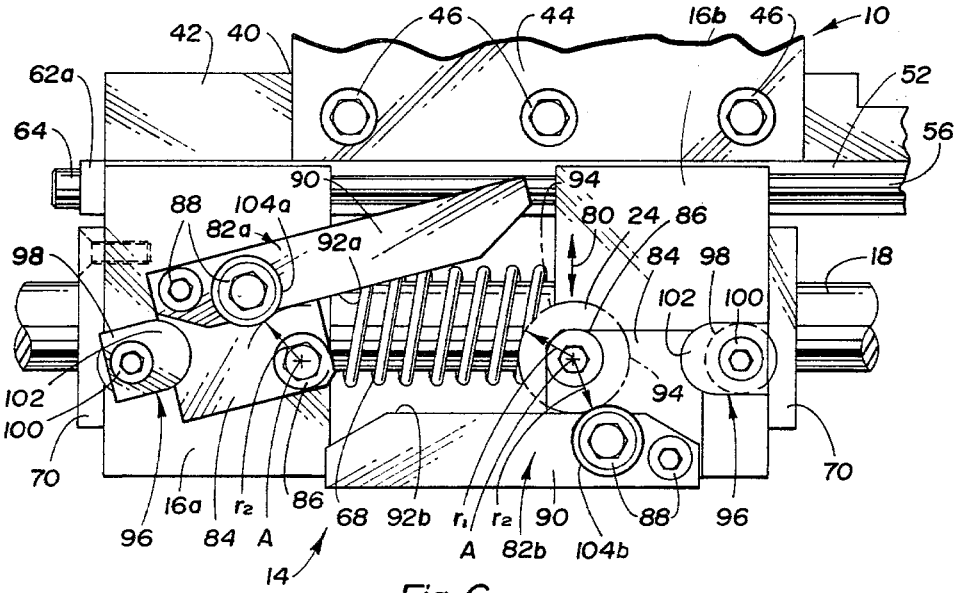
FIG. 6 is a partial plan view of the control valve unit taken along line 6—6 of FIG. 2.

As best seen in FIG. 4, a base 40 of the unit has an L shape including a pair of plates 42 and 44 that are secured to each other by bolts 46 as shown also in FIG. 6. Plates 42 and 44 respectively support the slide mechanism 14 and the control valve 22 and have an inside right angle junction that engages the upper left through-bolt 34 of cylinder 12 with the control unit 10 mounted on the cylinder as shown in FIG. 4. Cooperative pairs of through-bolt clamps 48 are secured to the plates 42 and 44 by associated bolts 50 (only one shown in FIG. 4) and engage the lower left and upper right through-bolts 34 on opposite sides of the upper left through-bolt engaged by the inside junction of the plates. Threading of the bolts 50 to edges of the plates 42 and 44 with the clamps 48 engaged with the through-bolts 34 provides mounting of the base 40 on the hydraulic cylinder 12 in a secured relationship.

Figure 5:
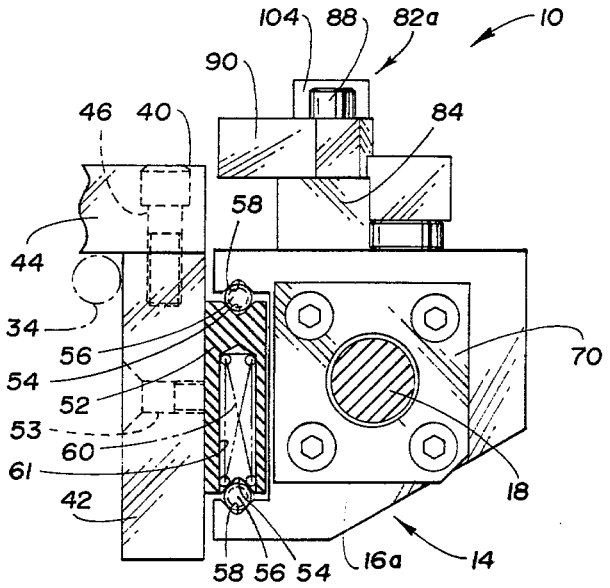
FIG. 5 is a partially sectioned view of the control valve unit taken along line 5—5 of FIG. 2.

As seen in FIG. 5, slide mechanism 14 includes a plate 52 that is secured to the base plate 42 by bolts 53 (only one shown) so as to provide a slideway on which the slides 16*a,b* are movable. Upper and lower edges of the plate 52 define V-shaped grooves 54 that respectively receive a pair of slide rods 56 also received by opposed slide surfaces defined on the slides 16*a,b* by V-shaped grooves 58. One or more springs 60 (only one shown) are respectively received within associated spring holes 61 and are compressed so that the lower ends thereof engage the lower slide rod 56 in order to provide a downward biasing that engages both of the slide rods 56 with the opposed slide surfaces defined by the grooves 54 and 58 on the slides 16*a,b*. Such a resilient mounting of the slide rods 56 provides an economical manner of mounting the slides 16*a,b* without requiring extensive machining normally required to provide a slideway. At the ends of the slideway plate 52, stops 62*a,b* (FIG. 2) are secured to this plate by associated bolts 64 with the slides 16*a,b* positioned therebetween such that the stops limit the movement of the slides to the left and the right.

Figure 2:
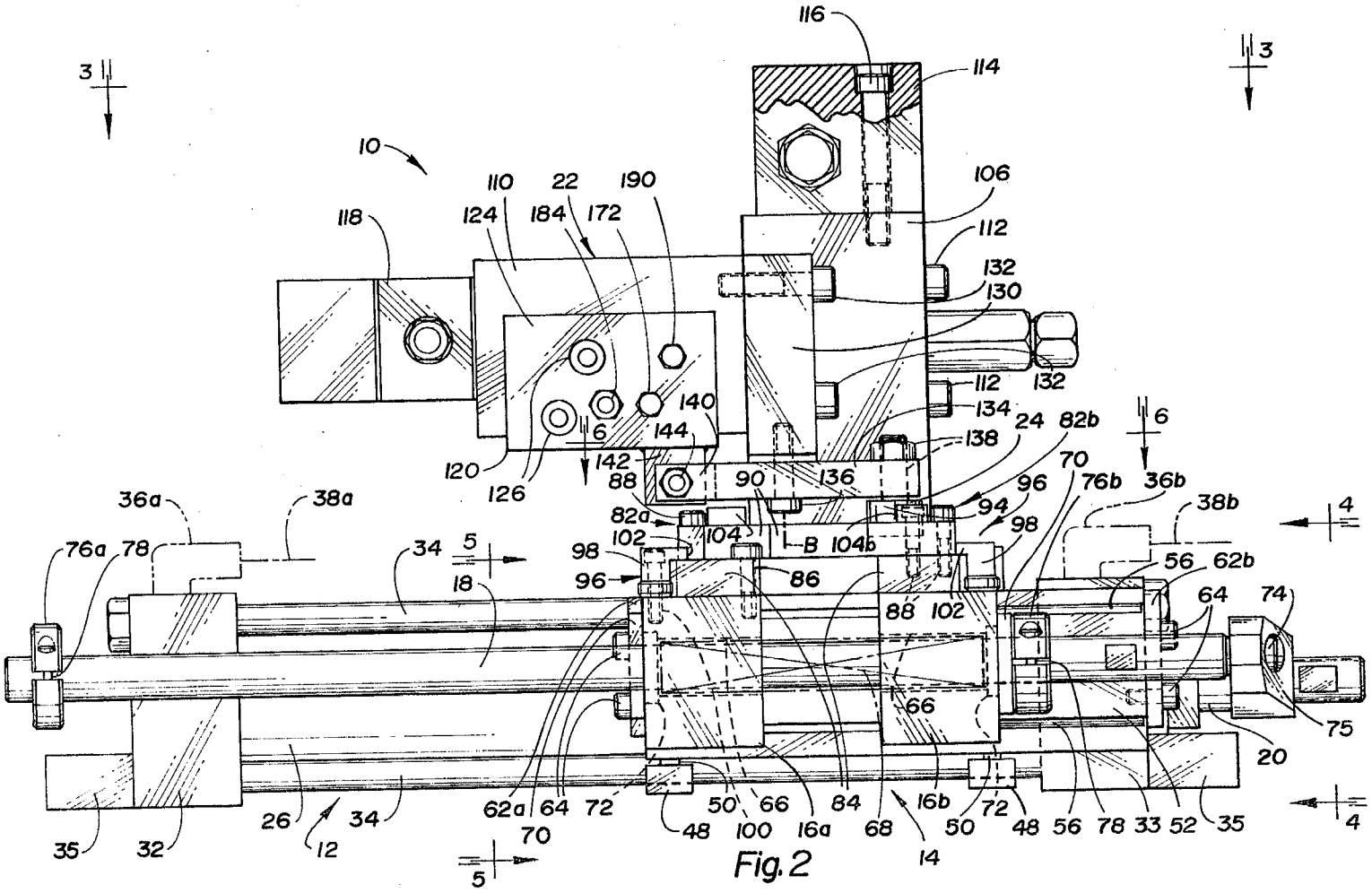
FIG. 2 is a side view of the control valve unit and the actuator.

With reference to FIG. 2, each of the slides 16*a,b* includes an opening 66 through which the control member 18 extends so as to be supported thereby for movement toward the right and the left under the driving impetus of the rod 20 connected to the piston of the cylinder. A spring 68 of the helical type also has the control member 18 extending therethrough and has opposite ends received within the slide openings 66. Each slide 16*a,b* includes a collar plate 70 secured thereto by recessed bolts with an annular rib 72 of the collar plate received within a complementary groove at the outer end of the associated slide opening 66 so as to seat the adjacent end of the spring 68. Spring 68 thus normally biases the slides 16*a,b* in opposite directions away from each other and into engagement with the stops 62*a,b* while permitting movement of the slides away from the stops under the action of the control member 18.

Figure 3:
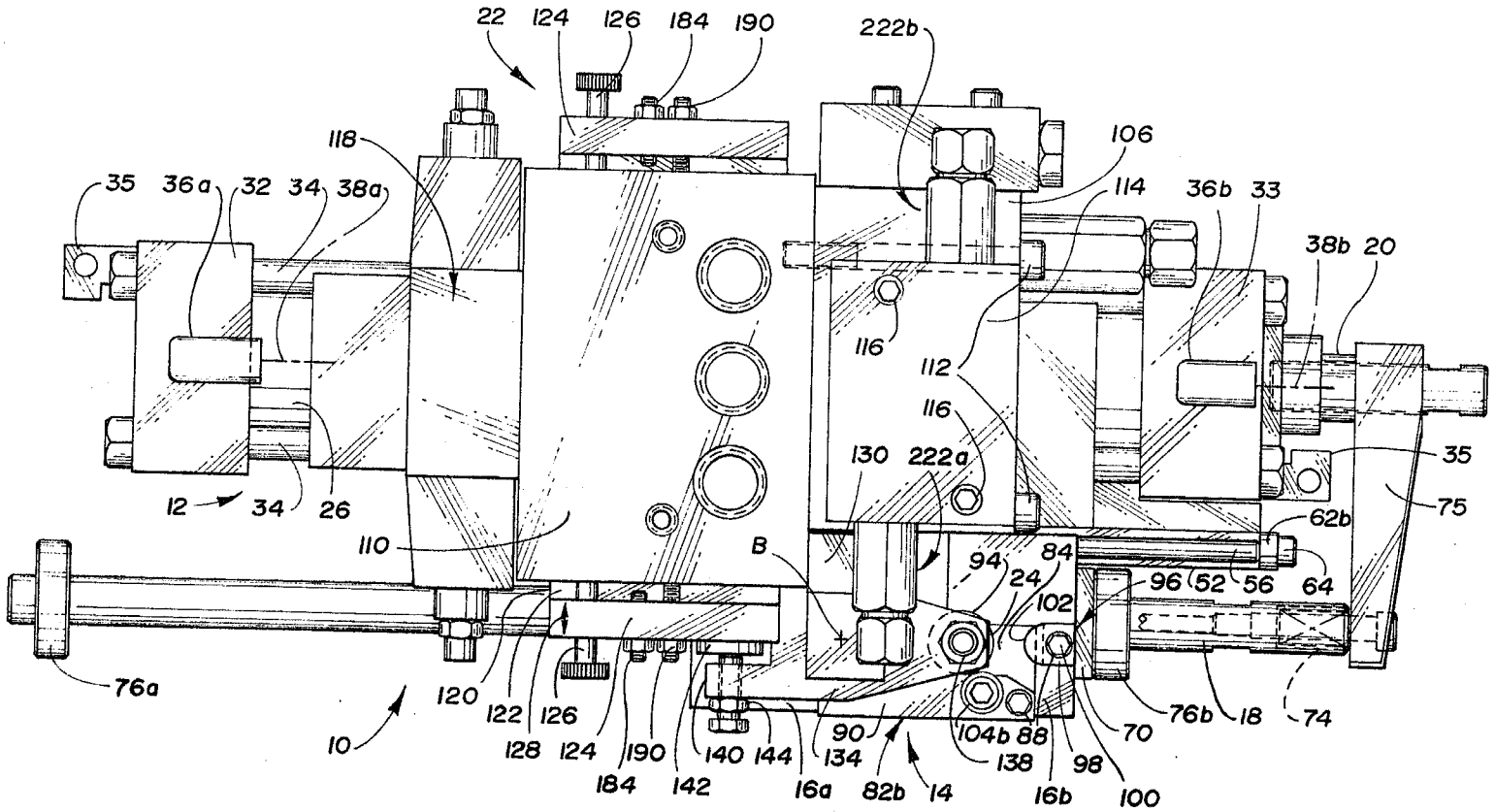
FIG. 3 is a top plan view of the control valve unit and the actuator taken along line 3—3 of FIG. 2.

As previously mentioned in connection with FIG. 1, movement of the slides 16*a,b* under the impetus of the control member 18 moves the control valve deactivator 24 in order to terminate driving operation of the hydraulic cylinder 12. Control member 18 has its right end secured as shown in FIG. 3 by a spring and bolt connection 74 to one end of an arm 75 whose other end is secured by a suitable connection to the piston rod 20. Spring and bolt connection 74 prevents backlash as the driving of the piston rod 20 moves arm 75 and the control member 18 in order to operate the control valve 22. Lugs on the control member 18 are embodied by a pair of adjustable collars 76*a,b* that respectively engage and move the slides 16*a,b* adjacent the limits of movement of the cylinder rod 20 so as to terminate such driving movement under the operation of control valve 22. Each collar 76*a,b* is made up of complementary half collars with bolts 78 extending therebetween so as to thereby provide adjustable mounts for positioning the collars along the control member 18 in a manner that allows adjustment of the extent of driving movement of the cylinder.

As seen in FIG. 6, deactivator 24 of the control valve is movable in opposite directions, as illustrated by arrow 80, by a pair of adjustable cams 82*a,b* which are respectively mounted on the slides 16*a,b*. Each adjustable cam 82*a,b* includes a base portion 84 which is secured to the associated slide by a pintle bolt 86 for adjustment about an associated pivotal support axis A. Bolts 88 secure a cam member 90 of each cam 82*a,b* to the associated base portion 84 thereof such that cam surfaces 92*a,b* of the cam members are aligned with the deactivator 24 in order to engage a round cam surface 94 thereof upon movement of the associated cam away from its stop under the impetus of the collars on the control member 18 as previously described. Positioners 96 respectively associated with the cams 82*a,b* each include a clamp member 98 that is secured by a bolt 100 to the associated slide 16*a,b* with a rounded nose 102 of the clamp member engaged with the base portion 84 of the cam 82*a,b* on the slide. Tightening of the bolt 100 pivotally locates the associated cam 82*a,b* on the slide so as to fix the angular relationship of the cam surface 92*a,b* thereof with respect to the direction of slide movement parallel with the direction of movement of the control member 18. As will be more fully hereinafter described, the control valve of the unit continues to drive the hydraulic cylinder until the deactivator 24 is moved toward the central position shown in FIG. 6 whereupon the driving movement of the cylinder is decelerated in a controlled manner and ultimately terminated upon reaching the central position. Appropriate adjustment of the cam surfaces 92*a,b* with respect to the slides 16*a,b* controls the rate at which the deactivator 24 is moved to the central position in relationship to the rate of slide movement in order to provide the controlled rate of deceleration.

With continuing reference to FIG. 6, one of the bolts 88 of each adjustable cam 82*a,b* secures a round cam member with a limit cam surface 104*a,b* as well as securing the associated cam member 90. Limit cam surfaces 104*a,b* engage the cam surface 94 on the deactivator 24 from opposite axial directions with respect to the axis of cylinder movement and from opposite sides. This engagement provides the final extent of deactivator movement to the central position and termination of the cylinder operation at precise positions without any creeping movement that could result in uncontrolled final positions. Cam surface 94 on the deactivator has a radius $r_1$ which is equal to the spacing $r_2$ of the limit cam surfaces 104*a,b* from their associated support axes A of pivotal adjustment. As such, adjustment of the cams 82*a,b* about the axes A to control the rate of deceleration does not change the final positions at which the limit cam surfaces 104*a,b* move the deactivator 24 to the central position to terminate the driving of the hydraulic cylinder in the associated direction.

With reference to FIG. 4, control valve 22 includes a manifold block 106 that is secured to the plate 44 of base 40 by a plurality of bolts 108, only one of which is shown. Manifold block 106 is in turn secured as shown in FIGS. 1 and 2, to a valve block 110 by bolts 112. A cross line relief valve assembly 114 is also secured to the manifold block 106 by bolts 116 so as to relieve any excessive pressure that may occur in either conduit 38*a* or 38*b*, as is hereinafter more fully described. Operation of the control valve 22 is controlled by a directional valve 118 that is secured in any suitable manner such as by bolts to the valve block 110 on the opposite side thereof as the manifold block 106.

Referring to FIGS. 1, 2, and 3, operation of the control valve 22 is controlled by a cradle 120 which includes a connecting portion 122 (FIG. 3) and upwardly extending legs 124 connected to opposite ends of the connecting portion. Connecting portion 122 of the cradle 120 extends below the lower side of the valve block 110 and the legs 124 are located on opposite sides of this valve block supported thereon by slide screws 126 for movement in opposite directions as shown by arrow 128 in FIG. 3. Control cradle 120 has a central position at which driving operation of the hydraulic cylinder is terminated as will be more fully hereinafter described. Movement of the cradle 120 from this central position in either direction under operation of the directional valve 118 commences driving of the hydraulic cylinder from a rest position in which the rod 20 is located to the opposite limit of travel whereupon the cradle is then moved to the central position to terminate the driving cylinder movement.

Referring now to FIGS. 2 and 3, a support block 130 is secured to the valve block 110 of the control valve by bolts 132 and has a lower side at which a deactivator lever 134 is pivotally secured by a bolt 136. Deactivator lever 134 is thus pivotal about a vertical axis B. One end of lever 134 receives a vertically extending threaded bolt connection 138 that mounts the deactivator 24. The other end of lever 134 is bifurcated and includes spaced legs 140 (FIG. 7) positioned on opposite sides of a downwardly extending projection 142 on the connecting portion 122 of cradle 120. Locking nut-studs 144 of each lever leg 140 engage the projection 142 in order to provide movement of the cradle 120 as the lever is pivoted by movement of deactivator 24 under the impetus of the slide mechanism.

Figure 7:
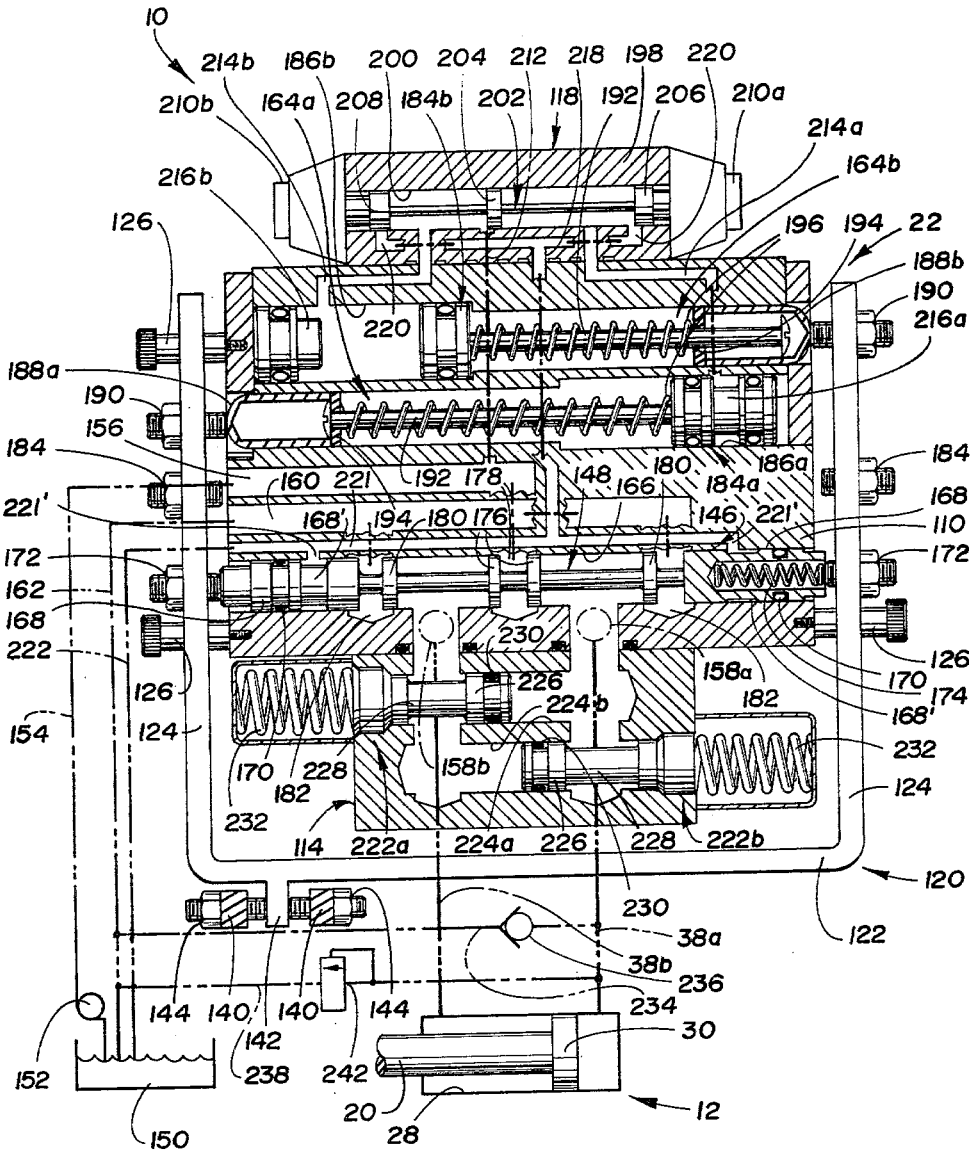
FIG. 7 is a schematic view illustrating a control valve of the unit and the manner in which operation thereof controls movement of the associated hydraulic linear actuator.

The structure of the control valve 22 and the operation of the control valve unit 10 can best be understood by reference to FIG. 7 which illustrates the unit in a condition with the hydraulic cylinder 12 at rest in its retracted position. Operation of the hydraulic cylinder 12 is controlled by a supply valve 146 whose spool 148 is movable to the left and the right by movement of cradle 120. Hydraulic fluid from a reservior 150 is pressurized by a pump 152 and fed through a conduit 154 to a high pressure supply passage 156 of the valve block 110. Operation of the valve 146 controls the supply of the pressurized fluid from passage 156 to the ports 158*a,b* which respectively feed the conduits 38*a,b* to provide extending or retracting movement of the hydraulic cylinder 12. A return passage 160 of valve block 110 feeds hydraulic fluid returned from the cylinder 12 under the control of the supply valve 146 back through a conduit 162 to the reservoir 150. In addition to supply valve 146, control valve 22 includes a pair of pilot pistons 164*a,b* which cooperate with the directional valve 118 to control movement of the cradle 120 in order to operate the supply valve in a manner which is more fully hereinafter described.

With continuing reference to FIG. 7, valve block 110 includes a bore 166 extending between the opposite sides thereof with the spool 148 of the supply valve 146 received within this bore. Left and right end lands 168 of valve spool 148 have associated seals 170 that provide a sealingly slidable relationship thereof within the bore 166. Adjustable nut studs 172 on the cradle legs 124 engage the spool end lands 168 in order to provide movement and positioning of the spool 148 and consequent control of the supply valve operation. It will be noted that the right end land 168 includes an axial bore which receives a spring 174 whose outer end is engaged by the nut stud 172 on the right cradle leg 124 in order to prevent any backlash during operation. Between its end lands, spool 148 includes central lands 176 that control communication of the supply valve bore 166 with a branch 178 of the high pressure passage 156. Right and left intermediate lands 180 of spool 148 are spaced from the end lands 168 and the central lands 176 by reduced diameter portions of the spool and cooperate therewith to control the flow of hydraulic fluid from cylinder 12 back through branches 182 of the return passage 160.

Movement of the cradle 120 to the left as viewed in FIG. 7 moves the valve spool 148 of the supply valve to the left so that pressurized hydraulic fluid from passage 156 flows through its branch 178 to the port 158*a* and whence through the conduit 38*a* to the cylinder bore 28 on the large area side of the piston 30 in order to provide extending movement of the rod 20. As this extending movement proceeds, hydraulic fluid is returned from the cylinder bore 28 on the small area side of the piston 30 to the port 158*b* through conduit 38*b* and whence to the left branch 182 of the return passage 160 for flow to the conduit 162 back into the reservoir 150. Similarly, movement of the cradle 120 to the right feeds pressurized hydraulic fluid from the branch 178 of the high pressure passage 156 to the port 158*b* for flow through the conduit 38*b* to the hydraulic cylinder bore 28 on the small area side of the piston 30 in order to provide retracting movement of rod 20. During the retracting movement, hydraulic fluid is returned from the cylinder bore 28 on the larger area side of piston 30 through conduit 38*a* to port 158*a* for flow through the right branch 182 of the return passage 160 back through the conduit 162 to the reservoir. In both directions of cradle movement, adjustable nut studs 184 on the cradle legs 124 engage the adjacent sides of the valve block 110 in order to limit the extent of such movement in either the left or right direction so as to control the opening movement of the supply valve 146 and hence the speed at which the cylinder 12 is extended or retracted by any selected level of fluid pressure. Movement of the cradle 120 back to the central position shown by operation of the slide mechanism previously described closes the supply valve 146 in order to terminate the movement of the hydraulic cylinder.

Pilot pistons 164*a,b* illustrated in FIG. 7 initiate movement of the cradle 120 from its central position in order to commence movement of the hydraulic cylinder in either direction. Each pilot piston 164*a,b* includes a piston end 184*a,b* having a O-ring seal so as to be sealingly slidable within its associated valve block bore 186*a,b*. Plunger ends 188*a,b* of the pilot pistons are slidable within associated block bores and respectively engaged with adjustable nut studs 190 on the cradle legs 124 in order to provide cradle positioning by the pilot piston operation. Connecting rods 192 of the pilot pistons have first ends respectively fixed to the piston ends 184*a,b* and second ends that slidably extend through central apertures in discs 194 of the plunger ends. A spring 196 of each pilot piston 164*a,b* extends between its piston end 184*a,b* and the disc 194 on its plunger end 188*a,b* to provide a bias that normally moves the pilot piston ends away from each other.

As previously mentioned, directional valve 118 shown in FIG. 7 is operated to initiate driving movement of the hydraulic cylinder 12 in either direction. A housing 198 of this valve is mounted on the valve block 110 in any suitable manner and defines a bore 200 having a valve spool 202 received thereby in a sealingly slidable relationship for movement to the left and the right. A central land 204 of spool 202 is connected to right and left end lands 206 and 208 by reduced diameter portions of the spool. End lands 206 and 208 of spool 202 are respectively engaged by the output plungers of solenoids 210*a,b* which are actuated to respectively move the spool 202 to the left and the right in order to initiate driving of the hydraulic cylinder 12 in the extending and retracting directions.

A supply passage 212 of the valve block 110 shown in FIG. 7 feeds high pressure fluid from passage 156 to the directional valve 118 and the positioning of the spool 202 of this valve selectively feeds the pressurized fluid to either passage 214*a* or *b* in order to pressurize one of the pilot piston bores 186*a* or *b*. Hydraulic fluid pressure within the pilot piston bores moves the associated pilot piston end 184*a* or *b* out of engagement with a cooperative stop 216*a* or *b* and thereby retracts the plunger and piston ends thereof so that the spring 196 of the retracted pilot piston biases the cradle 120 in the associated direction. A drain passage 218 for the directional valve 118 has right and left branch passages 220 that are respectively communicated with the ends of valve bore 200 in order to convey hydraulic fluid from the pilot piston bores to a drain passage 221 that feeds a conduit 222 for dumping into the reservoir 150. It will be noted that drain passage 221 also has branches 221' that communicate with the supply valve bore 166 at grooves 168' in the end lands of the spool therein so as to lessen the fluid pressure at the seals 170 and thereby lengthen the effective seal lifetime.

Operation of the hydraulic control unit 10 during an extending movement of the hydraulic cylinder 12 will now be described in connection with FIG. 7 wherein the control valve 22 is shown with the cylinder at rest subsequent to a driving cycle to the retracted position shown. In this condition, the pilot piston bore 186*b* is filled with pressurized hydraulic fluid so that pilot piston end 184*b* is positioned to the right against the bias of its associated spring 196 and the plunger 188*b* thus biases the cradle 120 to the right. However, the cam 82*b* of slide mechanism 14 engages the deactivator 24 as shown in FIG. 6 so that pivotal bias of the lever supporting the deactivator biases the right nut stud 144 shown in FIG. 7 toward the left to force the projection 142 of the cradle toward the left and thereby counteract the spring bias by pilot piston 164*b*. These counteracting forces thus position the cradle 120 in its central position so that supply valve 146 remains closed and the cylinder thus remains retracted.

Driving actuation of the hydraulic cylinder 12 from the retracted position of FIG. 7 toward the extended position is initiated by operation of the solenoid 210*a* of directional valve 118 in order to move the spool 202 toward the left so that the supply passage 212 is moved out of communication with the passage 214*b* and into communication with the passage 214*a*. Just before the high pressure fluid is switched from passage 214*b* to passage 214*a*, the movement of the valve spool 202 to the left moves the right end land 206 thereof to the left past the right drain passage 220 so that passage 214*a* is moved out of communication therewith and the left end land 208 of the spool moves to the left of the left drain passage 220 in order to communicate the passage 214*b* with the drain passage 218. Thus, spring 196 of the pilot piston 164*b* is allowed to extend the piston end 184*b* to the left and thereby force the hydraulic fluid in bore 186*b* through passage 214*b* and directional valve 118 to the drain passage 218 and whence to drain passage 221 for flow through conduit 222 to the reservoir. Simultaneously, pressurized fluid from the supply passage 212 is communicated through the directional valve 118 to the passage 214*a* in order to pressurize the bore 186*a* and move the piston end 184*a* therein toward the left as the rod 192 thereof slides through the plunger disc 194 in order to provide a retracted condition of pilot piston 164*a* which biases its plunger end 188*a* toward the left. Cradle 120 is thus relieved of the rightward bias by pilot piston 164*b* but is subjected to a leftward bias by the pilot piston 164*a* so as to move toward the left and thereby move the spool 148 of the supply valve 146 toward the left. Pressurized hydraulic fluid thus flows from the supply passage 156 through the supply valve 146 and to the port 158*a* for flow through conduit 38*a* to the cylinder bore 28 on the large area side of the piston 30 in order to provide piston movement toward the left and extension of rod 20. At the same time, hydraulic fluid in the cylinder bore 28 on the small area side of the piston 30 is forced through the conduit 38*b* and to the port 158*b* for flow through the left branch 182 of return passage 160 back through conduit 162 to the reservoir 150. Such extending movement of the cylinder 12 continues until the movement of the slide 16*a* on which the cam 82*a* is supported engages this cam with the deactivator 24 and thereby moves the cradle 120 back toward the right against the bias of pilot piston 164*a* to the central closed position of the supply valve 146 in order to terminate the driving operation of the cylinder.

Driving operation of the hydraulic cylinder 12 in a retracting direction is initiated by operation of the solenoid 210*b* of directional valve 118 which moves the valve spool 202 from the left toward the right to the position shown in FIG. 7. Pilot piston 164*a* is then allowed to extend under the bias of its spring 196 and pilot piston 164*b* is moved to a retracted position against the bias of its spring 196 as the directional valve 118 switches the supply and drain passages communicated with the associated piston end bores 186*a* and *b* of the pilot pistons. As such, the cradle 120 is moved toward the right in order to move the spool 148 of supply valve 146 toward the right and allow pressurized hydraulic fluid to flow to port 158*b* and through conduit 38*b* to the cylinder bore 28 on the small area side of the piston 30 in order to move the rod 20 to the right in a retracting direction. At the same time, hydraulic fluid is forced from the cylinder bore 28 on the large area side of the piston 30 through the conduit 38*a* to port 158*a* for flow through the right branch passage 182 of return passage 160 for passage through the conduit 162 to the reservoir 150. Such retracting movement of the hydraulic cylinder continues until the slide mechanism previously described moves the cradle 120 back toward the left to the central position where the supply valve 146 is closed in order to terminate the driving operation of the cylinder.

Cross line relief valve assembly 114 shown in FIG. 7 includes a pair of high pressure relief valves 222*a,b* for respectively relieving any excessive pressure that may build up on either side of the piston 30 during driving operation of the cylinder 12. Bores 224*a,b* provide for fluid communication between the ports 158*a* and *b* and respectively receive ends 226 on valve spool housings 228 of valves 222*a,b*. Each valve spool housing end 226 includes a seal 230 that closes the associated bore 224*a,b* in a sealed relationship. Springs 232 bias unshown spools within the spool housings 228 to closed positions so as to block fluid communication between the ports 158*a* and 158*b* which are respectively communicated with the large and small area sides of the piston 30 within the bore 28 of the hydraulic cylinder 12. An excessive hydraulic pressure on either side of the piston 30 within the cylinder 12, such as would result if the driving of the connecting rod 20 were blocked mechanically in either direction, will result in a pressure buildup at one of the ports 158*a* and *b* and will move the unshown spool of either valve 222*a* or *b* against the bias of its associated spring 232 in order to provide flow between the ports 158*a* and 158*b* in the appropriate direction to relieve the pressure buildup. Thus, the pressurized fluid from supply passage 156 flows through valve 146 and the opened valve 222*a* or *b* or the return passage 160 in order to relieve the pressure buildup.

In certain applications, the relatively large inertial load that is driven by the piston connecting rod 20 of the hydraulic cylinder 12 can cause continued piston movement even after the control valve 22 has terminated the supply of pressurized hydraulic fluid for such driving. In such instances, the unequal area relationship on opposite sides of the piston 30 with its single connecting rod 90 can generate either a vacuum or pressure buildup. In the extending direction of movement, to the left as shown in FIG. 7, inertial or other forced movement to the left after closing of the supply valve 146 results in an increased amount of fluid required within the hydraulic cylinder 12 and control valve 22 as well as the associated fluid circuitry. To prevent a vacuum from being generated on the large area side of the piston 30, a conduit 234 is provided extending between the conduit 38*a* and the return conduit 162 and includes a check valve 236 that opens to permit the flow of the required fluid from the reservoir 150 to the cylinder bore 28 on the large area side of the piston 30. As such, no vacuum is generated as a result of inertial or other forced piston movement subsequent to closing of the supply valve 146 of control valve 22.

Inertial or other forced driving of the piston 30 of hydraulic cylinder 12 in a retracting direction, toward the right as in FIG. 7, after closing of the supply valve 146 of control valve 22 results in an excessive amount of hydraulic fluid in the hydraulic cylinder 12 and the control valve 22 as well as the associated fluid circuitry. To prevent a pressure buildup of the hydraulic fluid during this condition, a conduit 238 is provided extending between the conduit 38*a* and the return conduit 162 and includes an adjustable pressure relief valve 242 for dumping excessive hydraulic fluid from the large area side of piston 30 to the reservoir 150 through this conduit. As such, pressure buildup is relieved from inertial or other forced movement of piston 30 in a retracting direction subsequent to closing of the supply valve 146 of control valve 22.

While the best mode for carrying out the invention has herein been described in detail, those familiar with the art to which this invention relates will recognize various alternative designs and embodiments for practicing the invention as defined by the following claims.

What is claimed is:

1. A control valve unit for a hydraulic linear actuator comprising: a base adapted to be mounted on the linear actuator; a control valve supported by the base and selectively operable to supply hydraulic fluid to the linear actuator to provide driving thereof in opposite directions; said control valve including a deactivator movable to terminate driving of the actuator in the associated direction; a slide mechanism on the base including a pair of movable slides; means for resiliently biasing the slides in opposite directions away from each other; said slides being movable against the bias thereof to engage and move the deactivator so as to terminate driving of the actuator; and a control member movable in response to driving of the actuator to respectively move the slides adjacent the limits of actuator movement in order to move the control valve deactivator and thereby terminate the driving of the actuator.

2. A control valve unit as in claim 1 wherein the slide mechanism includes a slideway on the base, a pair of fixed stops on the base, the pair of slides being slidably supported on the slideway between the stops, and said means for resiliently biasing the slides comprising a spring that respectively biases the slides against the stops.

3. A control valve unit as in claim 2 wherein each slide includes an opening through which the control member extends, the spring being of the helical type with the control member extending therethrough and having opposite ends respectively seated by the pair of slides, and the control member having a pair of lugs for respectively engaging the slides to provide the slide movement which terminates the driving of the linear actuator.

4. A control valve unit as in claim 3 wherein the lugs of the control member include adjustable mounts so as to permit adjustment of the locations at which driving of the linear actuator is terminated.

5. A control valve unit as in claim 2, 3, or 4 wherein each slide includes an adjustable cam for engaging and moving the deactivator.

6. A control valve unit as in claim 5 wherein each adjustable cam includes a pivotal support axis thereof on the associated slide and also includes a positioner for providing positioning thereof about its support axis, each cam having a cam surface whose positioning about the support axis controls the deactivator movement in relationship to the linear actuator movement in order to control the deceleration rate of the linear actuator.

7. A control valve unit as in claim 6 wherein the deactivator includes a round cam surface of a radius $r_1$, each adjustable cam including a cam surface having a limit cam surface positioned therealong at a location spaced from the associated pivotal support axis by a radius $r_2$ which is equal to $r_1$ so that the locations at which the linear actuator movement terminates are not affected by the adjusted positions of the cams.

8. A control valve unit as in claim 2 wherein the slideway includes a pair of slide rods, each slide having opposed slide surfaces that slidably engage the slide rods, and a spring for biasing one of the slide rods against the associated slide surfaces of the slides.

9. A control valve unit as in claim 1 wherein the base has an L shape and includes through-bolt clamps for mounting the base on the linear actuator.

10. A control valve unit for a hydraulic linear actuator comprising: a base adapted to be mounted on the linear actuator; a control valve supported by the base and selectively operable to supply hydraulic fluid to the linear actuator to provide driving thereof in opposite directions; said control valve including a deactivator having a central position and being movable thereto from opposite directions to terminate driving of the actuator in the associated directions; a slide mechanism on the base including a pair of movable slides having respective cam surfaces for engaging and moving the control valve deactivator to its central position; a pair of stops on the base between which the slides are movable; a spring for resiliently biasing the slides in opposite directions away from each other and into respective engagement with the stops; said slides being movable against the spring bias thereof to engage the cam surfaces with the deactivator so as to move the deactivator to its central position and thereby terminate driving of the actuator; and a control member movable in response to driving of the actuator and having a pair of control lugs for respectively engaging and moving the slides adjacent the limits of actuator movement in order to move the control valve deactivator to its central position and thereby terminate the driving of the actuator.

11. A control valve unit for a hydraulic linear actuator comprising: a base adapted to be mounted on the linear actuator; a control valve supported by the base and selectively operable to supply hydraulic fluid to the linear actuator to provide driving thereof in opposite directions; said control valve including a deactivator having a central position and being movable thereto from opposite directions to terminate driving of the actuator in the associated directions; a slide mechanism on the base including a pair of movable slides; each slide having an opening therethrough and an adjustable cam including a cam surface for engaging and moving the control valve deactivator to its central position; a pair of stops on the base between which the slides are movable; a helical spring having opposite ends engaged with the slides to provide biasing thereof in opposite directions away from each other and into respective engagement with the stops; said slides being movable against the spring bias thereof to engage the cam surfaces thereof with the deactivator so as to move the deactivator to its central position and thereby terminate driving of the actuator; a control member that extends through the slide openings and through the helical spring; said control member having an end adapted to be connected to the linear actuator so as to be movable therewith in response to driving of the actuator; a pair of control lugs on the control member for respectively engaging and moving the slides adjacent the limits of actuator movement in order to engage the cam surfaces with the deactivator and thereby move the deactivator to its central position to terminate the driving of the actuator; and positioners on the slides for locating the cams thereon to control the movement of the deactivator in relationship to the actuator movement and thereby control the deceleration rate of the actuator.

12. A control valve unit for a hydraulic linear actuator comprising: a base adapted to be mounted on the linear actuator; a control valve supported by the base and selectively operable to supply hydraulic fluid to the linear actuator to provide driving thereof in opposite directions; said control valve including a deactivator having a round cam surface of a radius $r_1$ and being pivotally movable about a support axis thereof to a central position from opposite directions so as to terminate driving of the actuator in the associated directions; a slide mechanism on the base including a pair of slide rods and a pair of slides having opposed slide surfaces that slidably engage the slide rods; each slide having an opening therethrough; a pair of cams respectively supported on the pair of slides about associated pivotal support axes which are parallel to each other and to the support axis of the deactivator; said cams having respective cam surfaces for engaging and moving the control valve deactivator to its central position; said cam surfaces of the pair of cams each having a limit cam surface positioned therealong at a location spaced from associated pivotal support axis thereof by a radius $r_2$ which is equal to $r_1$; a pair of stops on the base between which the slides are movable along the slide rods; a helical spring having opposite ends engaged with the slides to provide biasing thereof in opposite directions away from each other and into respective engagement with the stops; said slides being movable against the spring bias thereof to engage the cam surfaces thereof with the deactivator so as to move the deactivator to its central position and thereby terminate driving of the actuator; a control member that extends through the slide openings and through the helical spring; said control member having an end adapted to be connected to the linear actuator so as to be movable therewith in response to driving of the actuator; a pair of control lugs adjustably positioned on the control member to respectively engage and move the slides adjacent the limits of actuator movement in order to engage the cam surfaces with the deactivator and thereby move the deactivator to its central position to terminate the driving of the actuator; and positioners on the slides for locating the cam thereon to control the movement of the deactivator with respect to the actuator movement and thereby control the deceleration rate of the actuator without affecting the limits of actuator movement due to the relationship of the cam surface on the deactivator and the cam limit surfaces on the pair of cams.

13. A control valve unit as in claim 12 wherein the adjustable control lugs comprise collars that are adjustably clamped onto the control member.

14. A control valve unit as in claim 12 wherein the cam positioners of the slide include adjustable clamp members.

15. A control valve unit as in claim 12, 13, or 14 which includes through-bolt clamps for mounting the base on the linear actuator.

* * * * *